US012703944B2

(12) United States Patent
Sealey, II et al.

(10) Patent No.: US 12,703,944 B2
(45) **Date of Patent: *Aug. 11, 2026**

(54) PAPERMAKING MACHINE WITH PRESS SECTION

(71) Applicant: STRUCTURED I, LLC, Great Neck, NY (US)

(72) Inventors: James E. Sealey, II, Belton, SC (US); Byrd Tyler Miller, IV, Easley, SC (US); Marc Paul Begin, Simpsonville, SC (US); Theodore D. Kennedy, San Mateo, FL (US)

(73) Assignee: STRUCTURED I, LLC, Great Neck, NY (US)

( * ) Notice: Subject to any disclaimer, the term of this patent is extended or adjusted under 35 U.S.C. 154(b) by 154 days.

This patent is subject to a terminal disclaimer.

(21) Appl. No.: 18/667,125

(22) Filed: May 17, 2024

(65) Prior Publication Data

US 2024/0392503 A1 Nov. 28, 2024

Related U.S. Application Data

(63) Continuation-in-part of application No. 17/872,522, filed on Jul. 25, 2022, now Pat. No. 12,000,088, which is a continuation of application No. 16/932,903, filed on Jul. 20, 2020, now Pat. No. 11,466,404.

(60) Provisional application No. 62/933,577, filed on Nov. 11, 2019, provisional application No. 62/876,173, filed on Jul. 19, 2019.

(51) Int. Cl.

| | |
|---|---|
| ***D21F 1/66*** | (2006.01) |
| ***D21F 3/02*** | (2006.01) |
| ***D21F 9/00*** | (2006.01) |
| ***D21F 11/00*** | (2006.01) |

(52) U.S. Cl.

CPC ..... *D21F 1/66* (2013.01); *D21F 3/0272* (2013.01); *D21F 9/00* (2013.01); *D21F 11/006* (2013.01)

(58) Field of Classification Search

CPC ..... D21F 1/66
USPC ..... 162/358.1
See application file for complete search history.

(56) References Cited

U.S. PATENT DOCUMENTS

| | | | | |
|---|---|---|---|---|
| 6,395,136 | B1 * | 5/2002 | Andersson | D21F 3/0218 100/327 |
| 2002/0060049 | A1 * | 5/2002 | Kanitz | D21F 11/14 162/358.3 |
| 2004/0118545 | A1 * | 6/2004 | Bakken | D21F 7/083 162/903 |
| 2014/0284012 | A1 * | 9/2014 | Gustavsson | D21F 11/14 162/358.3 |
| 2018/0187377 | A1 * | 7/2018 | Ziegenbein | D21H 27/30 |

* cited by examiner

*Primary Examiner* — Jacob T Minskey
(74) *Attorney, Agent, or Firm* — Amster, Rothstein & Ebenstein LLP

(57) ABSTRACT

A machine or apparatus for producing structured tissue or towel using a press section.

25 Claims, 6 Drawing Sheets

| | Volume | CS area | Surface area | CS area | Surface area | Area ratio |
|---|---|---|---|---|---|---|
| | mm³ | mm² | mm² | | % | |
| Total | 1.1228 | 10.5277 | 3.2240534 | 29.591622 | 8.174837 | |
| Max | 0.1349 | 1.46703 | 2.0142254 | 5.7255552 | 3.812705 | |
| Min | 0.0009 | 0.0067 | 0.0007544 | 1.18729 | 0.004542 | |
| Ave | 0.04583 | 0.4362 | 0.1384571 | 1.2324857 | 0.227669 | |
| SD DV | 0.0608 | 0.4449 | 0.0923072 | 1.1624571 | 1.234425 | |
| 3 Sigma | 0.1824 | 1.3439 | 1.3687518 | 3.4425072 | 3.504475 | |

| | Volume | C.S. area | Surface area | C.S. area | Surface area | Area ratio |
|---|---|---|---|---|---|---|
| | $mm^3$ | $mm^2$ | $mm^2$ | | | % |
| Total | 4.35247 | 2.70991 | 42.325871 | | 31322424 | 53.4769 |
| Max | 4.3452 | 2.53852 | 42.148229 | | 91545714 | 53.3392 |
| Min | 0.10041 | 0.06412 | 0.020071 | | 1157234 | 0.065 |
| Ave | 0.54406 | 2.82726 | 5.2910297 | | 3.9226572 | 8.6845 |
| Sd OV | 1.43708 | 7.48257 | 13.822917 | | 2.2740371 | 17.6224 |
| 3 Sigma | 4.31231 | 22.45097 | 41.678245 | | 6.8221124 | 52.8672 |

PAPERMAKING MACHINE WITH PRESS SECTION

RELATED APPLICATIONS

This application is a continuation-in-part based on U.S. patent application Ser. No. 17/872,522, entitled PAPERMAKING MACHINE WITH PRESS SECTION and filed Jul. 25, 2022, which in turn is a continuation of U.S. patent application Ser. No. 16/932,903, entitled PAPERMAKING MACHINE WITH PRESS SECTION and filed Jul. 20, 2020, which in turn claims priority to and the benefit of U.S. Provisional Application No. 62/876,173, entitled PAPER MAKING MACHINE WITH PRESS SECTION and filed Jul. 19, 2019, and U.S. Provisional Application No. 62/933,577, entitled PAPER MAKING MACHINE WITH PRESS SECTION and filed Nov. 11, 2019, the contents of which are incorporated herein by reference in their entirety.

FIELD OF THE INVENTION

This invention relates to machines or apparatus for the production of tissue products, and in particular to such machines or apparatus that include fabrics or belts having polymeric layers.

BACKGROUND

Tissue manufacturers that can deliver the highest quality product at the lowest cost have a competitive advantage in the marketplace. A key component in determining the cost and quality of a tissue product is the manufacturing process utilized to create the product. For tissue products, there are several manufacturing processes available including conventional dry crepe, through air drying (TAD), or "hybrid" technologies such as Valmet's NTT and QRT processes, Georgia Pacific's ETAD, and Voith's ATMOS process. Each has differences as to installed capital cost, raw material utilization, energy cost, production rates, and the ability to generate desired attributes such as softness, strength, and absorbency.

Conventional manufacturing processes include a forming section designed to retain the fiber, chemical, and filler recipe while allowing the water to drain from the web. Many types of forming sections, such as inclined suction breast roll, twin wire C-wrap, twin wire S-wrap, suction forming roll, and Crescent formers, include the use of forming fabrics.

Forming fabrics are woven structures that utilize monofilaments (such as yarns or threads) composed of synthetic polymers (usually polyethylene terephthalate, or nylon). A forming fabric has two surfaces, the sheet side and the machine or wear side. The wear side is in contact with the elements that support and move the fabric and are thus prone to wear. To increase wear resistance and improve drainage, the wear side of the fabric has larger diameter monofilaments compared to the sheet side. The sheet side has finer yarns to promote fiber and filler retention on the fabric surface.

Different weave patterns are utilized to control other properties such as: fabric stability, life potential, drainage, fiber support, and clean-ability. There are three basic types of forming fabrics: single layer, double layer, and triple layer. A single layer fabric is composed of one yarn system made up of cross direction (CD) yarns (also known as shute yarns) and machine direction (MD) yarns (also known as warp yarns). The main issue for single layer fabrics is a lack of dimensional stability. A double layer forming fabric has one layer of warp yarns and two layers of shute yarns. This multilayer fabric is generally more stable and resistant to stretching. Triple layer fabrics have two separate single layer fabrics bound together by separated yarns called binders. Usually the binder fibers are placed in the cross direction but can also be oriented in the machine direction. Triple layer fabrics have further increased dimensional stability, wear potential, drainage, and fiber support than single or double layer fabrics.

The manufacturing of forming fabrics includes the following operations: weaving, initial heat setting, seaming, final heat setting, and finishing. The fabric is made in a loom using two interlacing sets of monofilaments (or threads or yarns). The longitudinal or machine direction threads are called warp threads and the transverse or cross machine direction threads are called shute threads. After weaving, the forming fabric is heated to relieve internal stresses to enhance dimensional stability of the fabric. The next step in manufacturing is seaming. This step converts the flat woven fabric into an endless forming fabric by joining the two MD ends of the fabric. After seaming, a final heat setting is applied to stabilize and relieve the stresses in the seam area. The final step in the manufacturing process is finishing, whereby the fabric is cut to width and sealed.

There are several parameters and tools used to characterize the properties of the forming fabric: mesh and count, caliper, frames, plane difference, open area, air permeability, void volume and distribution, running attitude, fiber support, drainage index, and stacking. None of these parameters can be used individually to precisely predict the performance of a forming fabric on a paper machine, but together the expected performance and sheet properties can be estimated. Examples of forming fabrics designs can be viewed in U.S. Pat. Nos. 3,143,150, 4,184,519, 4,909,284, and 5,806,569.

In a conventional dry crepe process, after web formation and drainage (to around 35% solids) in the forming section (assisted by centripetal force around the forming roll and, in some cases, vacuum boxes), a web is transferred from the forming fabric to a press fabric upon which the web is pressed between a rubber or polyurethane covered suction pressure roll and a Yankee dryer. The press fabric is a permeable fabric designed to uptake water from the web as it is pressed in the press section. It is composed of large monofilaments or multi-filamentous yarns, needled with fine synthetic batt fibers to form a smooth surface for even web pressing against the Yankee dryer. Removing water via pressing reduces energy consumption.

In a conventional TAD process, rather than pressing and compacting the web, as is performed in conventional dry crepe, the web undergoes the steps of imprinting and thermal pre-drying. Imprinting is a step in the process where the web is transferred from a forming fabric to a structured fabric (or imprinting fabric) and subsequently pulled into the structured fabric using vacuum (referred to as imprinting or molding). This step imprints the weave pattern (or knuckle pattern) of the structured fabric into the web. This imprinting step increases softness of the web and affects smoothness and the bulk structure. The manufacturing method of an imprinting fabric is similar to a forming fabric (see U.S. Pat. Nos. 3,473,576, 3,573,164, 3,905,863, 3,974,025, and 4,191,609 for examples) except for an additional step of overlaying a polymer.

Imprinting fabrics with an overlaid polymer are disclosed in U.S. Pat. Nos. 5,679,222, 4,514,345, 5,334,289, 4,528,239 and 4,637,859. Specifically, these patents disclose a method of forming a fabric in which a patterned resin is applied over a woven substrate. The patterned resin completely penetrates the woven substrate. The top surface of the patterned resin is flat and openings in the resin have sides that follow a linear path as the sides approach and then penetrate the woven structure.

U.S. Pat. Nos. 6,610,173, 6,660,362, and 6,998,017, and European Patent No. EP 1 339 915 disclose another technique for applying an overlaid resin to a woven imprinting fabric. According to this technique, the overlaid polymer has an asymmetrical cross sectional profile in at least one of the machine direction and a cross direction and at least one nonlinear side relative to the vertical axis. The top portion of the overlaid resin can be a variety of shapes and not simply a flat structure. The sides of the overlaid resin, as the resin approaches and then penetrates the woven structure, can also take different forms, not a simple linear path 90 degrees relative the vertical axis of the fabric. Both methods result in a patterned resin applied over a woven substrate. The benefit is that resulting patterns are not limited by a woven structure and can be created in any desired shape to enable a higher level of control of the web structure and topography that dictate web quality properties.

After imprinting, the web is thermally pre-dried by moving hot air through the web while it is conveyed on the structured fabric. Thermal pre-drying can be used to dry the web to over 90% solids before the web is transferred to a steam heated cylinder. The web is then transferred from the structured fabric to the steam heated cylinder though a very low intensity nip (up to 10 times less than a conventional press nip) between a solid pressure roll and the steam heated cylinder. The portions of the web that are pressed between the pressure roll and steam cylinder rest on knuckles of the structured fabric; thereby protecting most of the web from the light compaction that occurs in this nip. The steam cylinder and an optional air cap system, for impinging hot air, then dry the sheet to up to 99% solids during the drying stage before creping occurs. The creping step of the process again only affects the knuckle sections of the web that are in contact with the steam cylinder surface. Due to only the knuckles of the web being creped, along with the dominant surface topography being generated by the structured fabric, and the higher thickness of the TAD web, the creping process has a much smaller effect on overall softness as compared to conventional dry crepe. After creping, the web is optionally calendared and reeled into a parent roll and ready for the converting process. Some TAD machines utilize fabrics (similar to dryer fabrics) to support the sheet from the crepe blade to the reel drum to aid in sheet stability and productivity. Patents which describe creped through air dried products include U.S. Pat. Nos. 3,994,771, 4,102,737, 4,529,480, and 5,510,002.

The TAD process generally has higher capital costs as compared to a conventional tissue machine due to the amount of air handling equipment needed for the TAD section. Also, the TAD process has a higher energy consumption rate due to the need to burn natural gas or other fuels for thermal pre-drying. However, the bulk softness and absorbency of a paper product made from the TAD process is superior to conventional paper due to the superior bulk generation via structured fabrics, which creates a low density, high void volume web that retains its bulk when wetted. The surface smoothness of a TAD web can approach that of a conventional tissue web. The productivity of a TAD machine is less than that of a conventional tissue machine due to the complexity of the process and the difficulty of providing a robust and stable coating package on the Yankee dryer needed for transfer and creping of a delicate a pre-dried web.

UCTAD (un-creped through air drying) is a variation of the TAD process in which the sheet is not creped, but rather dried up to 99% solids using thermal drying, blown off the structured fabric (using air), and then optionally calendared and reeled. U.S. Pat. No. 5,607,551 describes an uncreped through air dried product.

A process/method and paper machine system for producing tissue has been developed by the Voith company and is marketed under the name ATMOS. The process/method and paper machine system have several variations, but all involve the use of a structured fabric in conjunction with a belt press. The major steps of the ATMOS process and its variations are stock preparation, forming, imprinting, pressing (using a belt press), creping, calendaring (optional), and reeling the web.

The stock preparation step of the ATMOS process is the same as that of a conventional or TAD machine. The forming process can utilize a twin wire former (as described in U.S. Pat. No. 7,744,726), a Crescent Former with a suction Forming Roll (as described in U.S. Pat. No. 6,821,391), or a Crescent Former (as described in U.S. Pat. No. 7,387,706). The former is provided with a slurry from the headbox to a nip formed by a structured fabric (inner position/in contact with the forming roll) and forming fabric (outer position). The fibers from the slurry are predominately collected in the valleys (or pockets, pillows) of the structured fabric and the web is dewatered through the forming fabric. This method for forming the web results in a bulk structure and surface topography as described in U.S. Pat. No. 7,387,706 (FIGS. 1-11). After the forming roll, the structured and forming fabrics separate, with the web remaining in contact with the structured fabric.

The web is now transported on the structured fabric to a belt press. The belt press can have multiple configurations. The press dewaters the web while protecting the areas of the sheet within the structured fabric valleys from compaction. Moisture is pressed out of the web, through the dewatering fabric, and into the vacuum roll. The press belt is permeable and allows for air to pass through the belt, web, and dewatering fabric, and into the vacuum roll, thereby enhancing the moisture removal. Since both the belt and dewatering fabric are permeable, a hot air hood can be placed inside of the belt press to further enhance moisture removal. Alternately, the belt press can have a pressing device which includes several press shoes, with individual actuators to control cross direction moisture profile, or a press roll. A common arrangement of the belt press has the web pressed against a permeable dewatering fabric across a vacuum roll by a permeable extended nip belt press. Inside the belt press is a hot air hood that includes a steam shower to enhance moisture removal. The hot air hood apparatus over the belt press can be made more energy efficient by reusing a portion of heated exhaust air from the Yankee air cap or recirculating a portion of the exhaust air from the hot air apparatus itself.

After the belt press, a second press is used to nip the web between the structured fabric and dewatering felt by one hard and one soft roll. The press roll under the dewatering fabric can be supplied with vacuum to further assist water removal. This belt press arrangement is described in U.S. Pat. Nos. 8,382,956 and 8,580,083, with FIG. 1 showing the arrangement. Rather than sending the web through a second press after the belt press, the web can travel through a boost dryer, a high pressure through air dryer, a two pass high pressure through air dryer or a vacuum box with hot air supply hood. U.S. Pat. Nos. 7,510,631, 7,686,923, 7,931, 781, 8,075,739, and 8,092,652 further describe methods and systems for using a belt press and structured fabric to make tissue products each having variations in fabric designs, nip pressures, dwell times, etc., and are mentioned here for reference. A wire turning roll can be also be utilized with vacuum before the sheet is transferred to a steam heated cylinder via a pressure roll nip.

The sheet is now transferred to a steam heated cylinder via a press element. The press element can be a through drilled (bored) pressure roll, a through drilled (bored) and blind drilled (blind bored) pressure roll, or a shoe press. After the web leaves this press element and before it contacts the steam heated cylinder, the % solids are in the range of 40-50%. The steam heated cylinder is coated with chemistry to aid in sticking the sheet to the cylinder at the press element nip and also to aid in removal of the sheet at the doctor blade. The sheet is dried to up to 99% solids by the steam heated cylinder and an installed hot air impingement hood over the cylinder. This drying process, the coating of the cylinder with chemistry, and the removal of the web with doctoring is explained in U.S. Pat. Nos. 7,582,187 and 7,905,989. The doctoring of the sheet off the Yankee, i.e., creping, is similar to that of TAD with only the knuckle sections of the web being creped. Thus, the dominant surface topography is generated by the structured fabric, with the creping process having a much smaller effect on overall softness as compared to conventional dry crepe. The web is now calendared (optional), slit, reeled and ready for the converting process.

The ATMOS process has capital costs between that of a conventional tissue machine and a TAD machine. It uses more fabrics and a more complex drying system compared to a conventional machine, but uses less equipment than a TAD machine. The energy costs are also between that of a conventional and a TAD machine due to the energy efficient hot air hood and belt press. The productivity of the ATMOS machine has been limited due to the inability of the novel belt press and hood to fully dewater the web and poor web transfer to the Yankee dryer, likely driven by poor supported coating packages, the inability of the process to utilize structured fabric release chemistry, and the inability to utilize overlaid fabrics to increase web contact area to the dryer. Poor adhesion of the web to the Yankee dryer has resulted in poor creping and stretch development which contributes to sheet handling issues in the reel section. The result is that the output of an ATMOS machine is currently below that of conventional and TAD machines. The bulk softness and absorbency are superior to conventional, but lower than a TAD web since some compaction of the sheet occurs within the belt press, especially areas of the web not protected within the pockets of the fabric. Also, bulk is limited since there is no speed differential to help drive the web into the structured fabric as exists on a TAD machine. The surface smoothness of an ATMOS web is between that of a TAD web and a conventional web primarily due to the current limitation on use of overlaid structured fabrics.

The ATMOS manufacturing technique is often described as a hybrid technology because it utilizes a structured fabric like the TAD process, but also utilizes energy efficient means to dewater the sheet like the conventional dry crepe process. Other manufacturing techniques which employ the use of a structured fabric along with an energy efficient dewatering process are the ETAD process and NTT process. The ETAD process and products are described in U.S. Pat. Nos. 7,339, 378, 7,442,278, and 7,494,563. The NTT process and products are described in WO 2009/061079 A1, United States Patent Application Publication No. 2011/0180223 A1, and United States Patent Application Publication No. 2010/0065234 A1. The QRT process is described in United States Patent Application Publication No. 2008/0156450 A1 and U.S. Pat. No. 7,811,418. A structuring belt manufacturing process used for the NTT, QRT, and ETAD imprinting process is described in U.S. Pat. No. 8,980,062 and United States Patent Application Publication No. US 2010/0236034.

The NTT process involves spirally winding strips of polymeric material, such as industrial strapping or ribbon material, and adjoining the sides of the strips of material using ultrasonic, infrared, or laser welding techniques to produce an endless belt. Optionally, a filler or gap material can be placed between the strips of material and melted using the aforementioned welding techniques to join the strips of materials. The strips of polymeric material are produced by an extrusion process from any polymeric resin such as polyester, polyamide, polyurethane, polypropylene, or polyether ether ketone resins. The strip material can also be reinforced by incorporating monofilaments of polymeric material into the strips during the extrusion process or by laminating a layer of woven polymer monofilaments to the non-sheet contacting surface of a finished endless belt composed of welded strip material. The endless belt can have a textured surface produced using processes such as sanding, graving, embossing, or etching. The belt can be impermeable to air and water, or made permeable by processes such as punching, drilling, or laser drilling. Examples of structuring belts used in the NTT process can be viewed in International Publication Number WO 2009/067079 A1 and United States Patent Application Publication No. 2010/0065234 A1.

As shown in the aforementioned discussion of tissue papermaking technologies, the fabrics or belts utilized are critical in the development of the tissue web structure and topography which, in turn, are instrumental in determining the quality characteristics of the web such as softness (bulk softness and surfaces smoothness) and absorbency. The manufacturing process for making these fabrics has been limited to weaving a fabric (primarily forming fabrics and structured fabrics) or a base structure and needling synthetic fibers (press fabrics) or overlaying a polymeric resin (overlaid structured fabrics) to the fabric/base structure, or welding strips of polymeric material together to form an endless belt.

Conventional overlaid structures require application of an uncured polymer resin over a woven substrate where the resin completely penetrates through the thickness of the woven structure. Certain areas of the resin are cured and other areas are uncured and washed away from the woven structure. This results in a fabric where airflow through the fabric is only possible in the Z-direction. Thus, in order for the web to dry efficiently, only highly permeable fabrics can be utilized, meaning the amount of overlaid resin applied needs to be limited. If a fabric of low permeability is produced in this manner, then drying efficiency is significantly reduced, resulting in poor energy efficiency and/or low production rates as the web must be transported slowly across the TAD drums or ATMOS drum for sufficient drying. Similarly, a welded polymer structuring layer is extremely planar and provides an even surface when laminating to a woven support layer, which results in airflow only in the Z-direction.

As described in U.S. Pat. No. 10,208,426 B2, the contents of which are hereby incorporated by reference in their entirety, fabrics comprised of extruded polymer netting laminated to a woven structure utilize less energy to dry the sheet compared to prior designs. Both the extruded polymer netting layer and woven layer have non-planar, irregularly shaped surfaces that when laminated together only bond together where the two layers come into direct contact. This creates air channels in the X-Y plane of the fabric through which air can travel when the sheet is being dried with hot air in the TAD, UCTAD, or ATMOS processes. Without being bound by theory, it is likely that the airflow path and dwell time is longer through this type of fabric, allowing the air to remove higher amounts of water compared to prior designs. Prior woven and overlaid designs create channels where airflow is restricted in regard to the X-Y plane and channeled in the Z-direction by the physical restrictions imposed by the monofilaments or polymers of the belt that create the pocket boundaries of the belt. The polymer netting/woven structure design allows for less restricted airflow in the X-Y plane such that airflow can move parallel through the belt and web across multiple pocket boundaries and thereby increase contact time of the airflow within the web to remove additional water. This allows for the use of lower permeable belts compared to prior fabrics without increasing the energy demand per ton of paper dried. The air flow in the X-Y plane also reduces high velocity air flow in the Z-direction as the sheet and fabric pass across the molding box, reducing the occurrence of pin holes in the sheet.

Additionally, a process for manufacturing the web contacting layer by laying down polymers of specific material properties in an additive manner under computer control (3-D printing) has been described in U.S. Pat. No. 10,099,425, the contents of which are incorporated herein by reference in their entirety.

There is a continuing effort to improve papermaking machines and processes for making paper.

SUMMARY OF THE INVENTION

An object of the present invention is to provide tissue paper of the highest quality and lowest cost. In exemplary embodiments, the present invention provides papermaking machines which incorporate the press section of U.S. Pat. No. 10,208,426 B2.

Exemplary embodiments of this invention are directed to a novel press section of a paper machine that can utilize a structuring fabric to produce high quality, high bulk tissue paper. This novel press section combines the low capital cost, high production rate, low energy consumption advantages of the Valmet NTT manufacturing process, but improves the quality to levels that can only be achieved currently utilizing TAD technology that has high capital cost, low production rates, and high energy consumption.

A papermaking machine according to an exemplary embodiment of the present invention comprises: (A) a wet section for forming a nascent paper web, the wet section comprising a gap former into which is deposited a paper slurry from a headbox to form the nascent paper web, the gap former comprising: (i) a forming wire; and (ii) a dewatering fabric, the dewatering fabric running in an endless loop about a forming roll, a suction roll and a first press element; (B) a first dewatering section comprising the suction roll and a first steam box through which passes the nascent paper web to form a partially dewatered paper web; (C) a press section for pressing the partially dewatered paper web, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; (D) a second dewatering section comprising a hot air hood and a through air drying (TAD) drum, through which passes the partially dewatered paper web travelling on the structuring belt; and (E) a drying section for drying the partially dewatered paper web to form a dried web, the drying section comprising: (i) a second press element with the inside surface of the structuring fabric in contact with the second press element; (ii) a steam heated cylinder; and (iii) a second nip, formed between the structuring fabric in contact with the second press element and the steam heated cylinder, in which the partially dewatered paper web is pressed and transferred to the steam heated cylinder, wherein the dried web is creped off the steam heated cylinder.

A papermaking machine according to an exemplary embodiment of the present invention comprises: (A) a wet section for forming a nascent paper web, the wet section comprising a gap former into which is deposited a paper slurry from a headbox to form the nascent paper web, the gap former comprising: (i) a forming wire; and (ii) a dewatering fabric, the dewatering fabric running in an endless loop about a forming roll and a first press element; (B) a press section for pressing a partially dewatered paper web formed from the nascent web, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; (C) a dewatering section comprising a hot air hood and a through air drying (TAD) drum, through which passes the partially dewatered paper web travelling on the structuring belt; and (D) a drying section for drying the partially dewatered paper web to form a dried web, the drying section comprising: (i) a second press element with the inside surface of the structuring fabric in contact with the second press element; (ii) a steam heated cylinder; and (iii) a second nip, formed between the structuring fabric in contact with the second press element and the steam heated cylinder, in which the partially dewatered paper web is pressed and transferred to the steam heated cylinder, wherein the dried web is creped off the steam heated cylinder.

According to an exemplary embodiment of the present invention, a method for making paper comprises: (A) forming a nascent paper web by depositing a paper slurry from a headbox into a gap former of a wet section of a papermaking machine, the gap former comprising: (i) a forming wire; and (ii) a dewatering fabric, the dewatering fabric running in an endless loop about a forming roll, a suction roll and a first press element; (B) forming a partially dewatered paper web by passing the nascent paper web through a first dewatering section of the papermaking machine comprising the suction roll and a first steam box; (C) pressing the partially dewatered paper web at a press section of the papermaking machine, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; (D) passing the partially dewatered paper web travelling on the structuring belt through a second dewatering section of the papermaking machine comprising a hot air hood and a through air drying (TAD) drum; (E) drying the partially dewatered paper web at a drying section of the papermaking machine to form a dried web, the drying section comprising: (i) a second press element with the inside surface of the structuring fabric in contact with the second press element; (ii) a steam heated cylinder; and (iii) a second nip, formed between the structuring fabric in contact with the second press element and the steam heated cylinder, in which the partially dewatered paper web is pressed and transferred to the steam heated cylinder, wherein the structuring fabric at the second nip is compressed resulting in a top plane of a first element of the structuring fabric being in substantially the same plane as a top plane of a second element of the structuring fabric; and (F) creping the dried web off the steam heated cylinder.

A papermaking machine according to an exemplary embodiment of the present invention comprises: (A) a wet section for forming a nascent paper web, the wet section comprising a gap former into which is deposited a paper slurry from a headbox to form the nascent paper web, the gap former comprising: (i) a forming wire; and (ii) a dewatering fabric, the dewatering fabric running in an endless loop about a forming roll, a suction roll and a first press element; (B) a first dewatering section comprising the suction roll and a first steam box through which passes the nascent paper web to form a partially dewatered paper web; (C) a press section for pressing the partially dewatered paper web, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; and (D) a second dewatering section comprising a hot air hood and a through air drying (TAD) drum, through which passes the partially dewatered paper web travelling on the structuring belt.

A papermaking machine according to an exemplary embodiment of the present invention comprises: (A) a wet section for forming a nascent paper web, the wet section comprising a gap former into which is deposited a paper slurry from a headbox to form the nascent paper web, the gap former comprising: (i) a forming wire; and (ii) a dewatering fabric, the dewatering fabric running in an endless loop about a forming roll and a first press element; (B) a press section for pressing a partially dewatered paper web formed from the nascent web, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; and (C) a dewatering section comprising a hot air hood and a through air drying (TAD) drum, through which passes the partially dewatered paper web travelling on the structuring belt.

According to an exemplary embodiment of the present invention, a method for making paper comprising: (A) forming a nascent paper web by depositing a paper slurry from a headbox into a gap former of a wet section of a papermaking machine, the gap former comprising: (i) a forming wire; and (ii) a dewatering fabric, the dewatering fabric running in an endless loop about a forming roll, a suction roll and a first press element; (B) forming a partially dewatered paper web by passing the nascent paper web through a first dewatering section of the papermaking machine comprising the suction roll and a first steam box; (C) pressing the partially dewatered paper web at a press section of the papermaking machine, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; and (D) passing the partially dewatered paper web travelling on the structuring belt through a second dewatering section of the papermaking machine comprising a hot air hood and a through air drying (TAD) drum.

A papermaking machine according to an exemplary embodiment of the present invention comprises: (A) a wet section for forming a nascent paper web, the wet section comprising a gap former into which is deposited a paper slurry from a headbox to form the nascent paper web, the gap former comprising: (i) a forming wire; and (ii) a dewatering fabric, the dewatering fabric running in an endless loop about a forming roll, a suction roll and a first press element; (B) a first dewatering section comprising the suction roll and a first steam box through which passes the nascent paper web to form a partially dewatered paper web; (C) a press section for pressing the partially dewatered paper web, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; (D) a second dewatering section comprising at least one of: (i) a second steam box and a vacuum device; or (ii) a hot air hood and an exhaust duct, through which passes the partially dewatered paper web travelling on the structuring belt; and (E) a drying section for drying the partially dewatered paper web, the drying section comprising: (i) a second press element with the inside surface of the structuring fabric in contact with the second press element; (ii) a steam heated cylinder; and (iii) a second nip, formed between the structuring fabric in contact with the second press element and the steam heated cylinder, in which the partially dewatered paper web is pressed and transferred to the steam heated cylinder.

In an exemplary embodiment the dewatering fabric comprises polymer monofilaments or multi-filamentous yarns, needled with fine synthetic batt fibers.

In an exemplary embodiment the dewatering fabric further comprises absorbent porous materials.

In an exemplary embodiment the dewatering fabric further comprises extruded polymer netting.

In an exemplary embodiment the first press element is an extended nip press.

In an exemplary embodiment the press section extended nip press is a shoe press or belt press.

In an exemplary embodiment the press section extended nip press comprises a sleeve which is plain grooved, blind drilled, through drilled, or a combination thereof.

In an exemplary embodiment the suction element is a suction pressure roll.

In an exemplary embodiment the suction pressure roll comprises a roll cover made of polymeric material, where the cover of the press is grooved, blind drilled, through drilled, or a combination thereof.

In an exemplary embodiment the suction element is a vacuum box or suction pickup shoe.

In an exemplary embodiment the structuring belt is of a type selected from the group consisting of: a woven fabric, a woven fabric with an overlaid polymer, welded strips of polymeric material or extruded sheets of polymer which are etched by punching, drilling, or laser drilling, woven fabrics laminated with a 3-D printed web contacting or structuring layer, a structuring fabric made entirely from 3-D printed material, a laminated structuring fabric with a web-contacting layer made from extruded polymer netting or 3-D printed material laminated to a woven fabric or a dewatering fabric, and a fabric comprising a web-contacting layer made from extruded polymer netting or 3-D printed material laminated to a triple layer woven fabric which is then laminated to a dewatering fabric where fine synthetic batt fibers of the dewatering fabric are needled into the dewatering fabric and through a bottom layer of the triple layer woven fabric of the web contacting layer after the web contacting layer has been laminated to the dewatering fabric.

In an exemplary embodiment the structuring belt is a laminated fabric comprising a web contacting layer made from extruded polymer netting or 3-D printed material and a non-web contacting layer made of a woven fabric or a dewatering fabric.

In an exemplary embodiment the drying section press element comprises a shoe press, a suction pressure roll, or a plain press roll with a narrow nip width and high nip intensity.

In an exemplary embodiment the drying section press element is a shoe press, and the shoe press comprises a sleeve and the sleeve of the press is plain, grooved, blind drilled, through drilled, or a combination thereof.

In an exemplary embodiment the drying section press element is a suction pressure roll, and the section pressure roll has a roll cover made of rubber, polyurethane, or other polymers and the cover is grooved, blind drilled, through drilled, or a combination thereof.

In an exemplary embodiment the vacuum device comprises a vacuum roll, vacuum box, or vacuum shoe.

In an exemplary embodiment the first press element is a conventional plain press roll with a narrow nip width and high nip intensity with a rubber or polyurethane cover that is flat or has blind drilled holes and/or grooves.

In an exemplary embodiment the first press element is a capillary dewatering roll.

In an exemplary embodiment travel speed of the dewatering fabric is the same or different from travel speed of the structuring belt.

In an exemplary embodiment the structuring belt functions as a dewatering belt.

A papermaking machine according to an exemplary embodiment of the present invention comprises: (A) a wet section for forming a nascent paper web, the wet section comprising a gap former into which is deposited a paper slurry from a headbox to form the nascent paper web, the gap former comprising: (i) a forming wire; and (ii) a dewatering fabric, the dewatering fabric running in an endless loop about a forming roll and a first press element; (B) a press section for pressing a partially dewatered paper web formed from the nascent web, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; (C) a dewatering section comprising at least one of: (i) a steam box and a vacuum device; or (ii) a hot air hood and an exhaust duct, through which passes the partially dewatered paper web travelling on the structuring belt; and (D) a drying section for drying the partially dewatered paper web, the drying section comprising: (i) a second press element with the inside surface of the structuring fabric in contact with the second press element; (ii) a steam heated cylinder; and (iii) a second nip, formed between the structuring fabric in contact with the second press element and the steam heated cylinder, in which the partially dewatered paper web is pressed and transferred to the steam heated cylinder.

A papermaking machine according to an exemplary embodiment of the present invention comprises: (A) a wet section for forming a nascent paper web, the wet section comprising a gap former into which is deposited a paper slurry from a headbox to form the nascent paper web, the gap former comprising: (i) a forming wire; and (ii) a dewatering fabric, the dewatering fabric running in an endless loop about a forming roll, a suction roll and a first press element; (B) a dewatering section comprising the suction roll and a steam box through which passes the nascent paper web to form a partially dewatered paper web; (C) a press section for pressing the partially dewatered paper web, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; and (D) a drying section for drying the partially dewatered paper web, the drying section comprising: (i) a second press element with the inside surface of the structuring fabric in contact with the second press element; (ii) a steam heated cylinder; and (iii) a second nip, formed between the structuring fabric in contact with the second press element and the steam heated cylinder, in which the partially dewatered paper web is pressed and transferred to the steam heated cylinder.

A papermaking machine according to an exemplary embodiment of the present invention comprises: (A) a wet section for forming a nascent paper web, the wet section comprising a gap former into which is deposited a paper slurry from a headbox to form the nascent paper web, the gap former comprising: (i) a forming wire; and (ii) a dewatering fabric, the dewatering fabric running in an endless loop about a forming roll and a first press element; (B) a press section for pressing a partially dewatered paper web formed from the nascent web, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; (C) a drying section for drying the partially dewatered paper web, the drying section comprising: (i) a second press element with the inside surface of the structuring fabric in contact with the second press element; (ii) a steam heated cylinder; and (iii) a second nip, formed between the structuring fabric in contact with the second press element and the steam heated cylinder, in which the partially dewatered paper web is pressed and transferred to the steam heated cylinder.

A method for making paper according to an exemplary embodiment of the present invention comprises: (A) forming a nascent paper web by depositing a paper slurry from a headbox into a gap former of a wet section of a papermaking machine, the gap former comprising: (i) a forming wire; and (ii) a dewatering fabric, the dewatering fabric running in an endless loop about a forming roll, a suction roll and a first press element; (B) forming a partially dewatered paper web by passing the nascent paper web through a first dewatering section of the papermaking machine comprising the suction roll and a first steam box; (C) pressing the partially dewatered paper web at a press section of the papermaking machine, the press section comprising: (i) the first press element with an inside surface of the dewatering fabric in contact with the first press element; (ii) a structuring belt with an inside surface of the structuring belt in contact with a suction element; and (iii) a first nip, formed between the dewatering fabric in contact with the first press element and the structuring belt in contact with the suction element, in which the partially dewatered paper web is pressed and transferred to the structuring belt; (D) passing the partially dewatered paper web travelling on the structuring belt through a second dewatering section of the papermaking machine comprising at least one of: (i) a second steam box and a vacuum device; or (ii) a hot air hood and an exhaust duct; and (E) drying the partially dewatered paper web at a drying section of the papermaking machine, the drying section comprising: (i) a second press element with the inside surface of the structuring fabric in contact with the second press element; (ii) a steam heated cylinder; and (iii) a second nip, formed between the structuring fabric in contact with the second press element and the steam heated cylinder, in which the partially dewatered paper web is pressed and transferred to the steam heated cylinder, wherein the structuring fabric at the second nip is compressed resulting in a top plane of a first element of the structuring fabric being in substantially the same plane as a top plane of a second element of the structuring fabric.

A papermaking machine according to an exemplary embodiment of the present invention comprises: a wet section for forming a nascent paper web, the wet section comprising: a forming wire; a dewatering fabric, the dewatering fabric running in an endless loop about a forming roll, a suction roll and a first press element; and a first nip formed between the forming wire and the dewatering fabric into which is deposited a paper slurry from a headbox to form the nascent paper web; a first dewatering section comprising the suction roll and a first steam box through which passes the nascent paper web to form a partially dewatered paper web; a press section for pressing the partially dewatered paper web, the press section comprising: the first press element with an inside surface of the dewatering fabric in contact with the first press element; a structuring belt with an inside surface of the structuring belt in contact with a suction element; and a second nip, formed between the dewatering fabric in contact with the first press element and the structuring belt in contact with the suction element, in which the partially dewatered paper web is pressed and transferred to the structuring belt; a second dewatering section comprising a second steam box and a vacuum device through which passes the partially dewatered paper web travelling on the structuring belt; and a drying section for drying the partially dewatered paper web, the drying section comprising: a second press element with the inside surface of the structuring fabric in contact with the second press element; a steam heated cylinder; and a third nip, formed between the structuring fabric in contact with the second press element and the steam heated cylinder, in which the partially dewatered paper web is pressed and transferred to the steam heated cylinder.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Exemplary embodiments of the present invention describe the use of an expandable TAD fabric with a structured tissue machine design. The expandable structured tissue fabric enables the sheet to be compressed in a press section and water removal along a higher contact area than a more ridged PET woven TAD fabric. The use of a multi-layer structuring fabric enables the sheet contacting layer to be flexible and spring back to original or close to original dimensions which enable the paper sheet to expand in a 3-D shape or be imprinted (stretched in the z axis) allowing higher sheet porosity to occur after pressing which allows hot air flow to be transported through the sheet. While the sheet at this point of compaction is significantly higher in moisture content than typical imprinting conditions on a conventional TAD machine, the memory in the sheet before pressing plays a role in enabling movement of the web in the z-direction after pressing and during fabric/paper sheet "spring back". The spring back after pressing can be enhanced by vacuum and/or many other methods to produce z-direction forces on the paper web into the multilayer structuring fabric in the higher caliper state after pressing.

Figure 1:
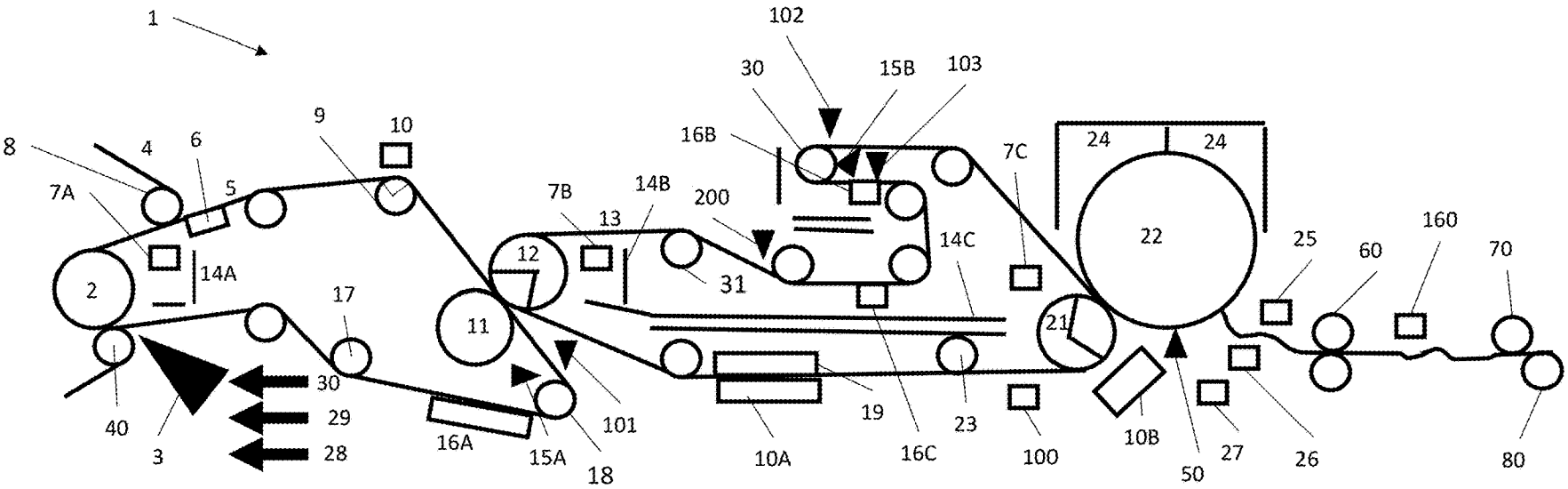
FIG. 1 is a block diagram of a papermaking machine according to an exemplary embodiment of the present invention.

FIG. 1 shows a block diagram of a papermaking machine, generally designated by reference number 1, according to an exemplary embodiment of the present invention. The papermaking machine 1 includes a first exterior layer fan pump 28, a core layer fan pump 29, and a second exterior layer fan pump 30. The fan pumps 28, 29, 30 move a dilute slurry of fiber and chemicals to a triple layer headbox 3 which deposits the slurry into a nip formed by a forming roll 2, a breast roll 40, an outside forming fabric 4 and an inside dewatering fabric 5.

The outer forming fabric is preferably a triple layer forming fabric, such as, for example, the T-Star AJ-494 Forming Fabric provided by Asten Johnson (4399 Corporate Road, Charleston, South Carolina, USA 29405), but can be any other forming fabric design. Forming fabric 4 runs in an endless loop around a plurality of guide rolls 8 to return back to the breast roll 40.

The forming roll 2 is preferably a solid rubber covered roll, but can be any other type of forming roll, such as an impermeable or permeable roll with an internal vacuum box, and may be covered with a smooth or textured material. The forming roll cover may be made from a material selected from, but not limited to rubber, or polyurethane. The cover may also have a pattern of filaments made of metal or polymer to create a texture.

Excess water may be doctored from the forming roll using a single, double, or triple doctor 7A to aid in removing water that may be wringing the roll and rewetting the web. The water is captured in a pan 14A and directed off the machine to prevent stock and water buildup on the machine frame, which may otherwise lead to drips and holes in the tissue webs and subsequent sheet-breaks and lost operating time.

The dewatering fabric 5 is typically comprised of large polymer monofilaments or multi-filamentous yarns, needled with fine synthetic batt fibers to form a smooth surface for even web pressing. However, any type of dewatering fabric can be used, such as, for example, the fabric shown in FIG. 14A of U.S. Pat. No. 7,476,294, the contents of which are incorporated herein by reference in their entirety, where other absorbent porous materials are incorporated. Another example of a fabric structure that may be used as the dewatering fabric 5 is described in U.S. Pat. No. 10,208,426, and includes nylon woven monofilaments, laminated to extruded polymer netting for compression resistance, and then needle punched with batt fiber on the surface and through the structure.

After separation of the forming and dewatering fabric, a vacuum transfer box 6 is used to assist in nascent web adherence to the dewatering fabric 5. The dewatering fabric 5 then travels with the web across a dewatering suction device comprised of suction roll 9 and steam box 10. In other exemplary embodiments, the dewatering suction device may be omitted. The steambox applies approximately 0.1-1.0 ton of steam per ton of paper to heat the water in the web and lower the viscosity to improve water removal through the suction roll 9. Other dewatering devices known in the art can be used, such as, for example, a vacuum box or suction shoe, which are both non-rotating water removal devices and therefore not preferred as they can cause wear to the dewatering fabric.

The web travels across the dewatering device and into the press section comprised of a press element 11, suction element 12, the dewatering fabric 5, and structuring fabric 13. Press element 11 is preferably an extended nip press, such as, for example, a shoe press or belt press. Extended nip presses extend the time that the paper web remains in the press nip. The amount of water removed in the nip is proportional to the magnitude and the duration of the pressure applied to the paper web. Using an extended nip, the manufacturer can utilize less pressure to achieve the same amount of dewatering while maintaining web bulk and preserving fabric life. Examples of a shoe press include the Advantage ViscoNip Press from Valmet (Keilasatama 5/PO Box 11 FI-02150 ESPOO, FINLAND), and the NipcoFlex T from Voith (St. Pöltener Straße 43 89522 Heidenheim Germany). FIG. 16 of U.S. Pat. No. 7,351,307, the contents of which are incorporated herein by reference in their entirety, shows an example of a suitable belt press. In exemplary embodiments, the shoe press cover may be made of rubber, polyurethane, or other material with through drilled holes, blind drilled holes, grooves, or a combination thereof. Suction element 12 is preferably a suction pressure roll which contains a rubber, polyurethane, or other material cover with through drilled holes, blind drilled holes, grooves, or a combination thereof. Other dewatering devices known in the art can be used, such as, for example, a vacuum box or suction shoe (pickup shoe), which are both non-rotating water removal devices and therefore not preferred as they can cause wear to the structuring fabric. The press section may instead include conventional plain press rolls with a narrow nip width and high nip intensity, or capillary rolls (as described in U.S. Pat. No. 5,701,682, the contents of which are incorporated herein by reference in their entirety), or a combination thereof, although this is not preferred because the web would lose bulk and quality. In an exemplary embodiment, a machine direction dominated pattern on the structuring fabric lines up opposite the grooves on the suction pressure roll for enhanced water removal. As used herein, the term narrow nip width is intended to mean a nip width of less than about 9 cm or from about 4 cm to about 8 cm or less than about 8 cm, and high nip intensity is intended to mean a nip intensity greater than about 5,000 $kN/m^2$ or from about 6,000 to about 12,000 $kN/m^2$ or greater than about 6,000 $kN/m^2$.

The structuring fabric 13 can be of any type described in the background section of this patent application, such as a woven fabric, a woven fabric with an overlaid polymer, welded strips of polymeric material or extruded sheets of polymer which are etched by punching, drilling, or laser drilling, woven fabrics laminated with a 3-D printed web contacting or structuring layer, or a structuring fabric made entirely from 3-D printed material As the web travels on the dewatering fabric 5 through the first press nip, the dewatering fabric 5 and the structuring fabric 13 are subjected to compression and expansion, thereby uptaking and removing water from both sides of the web. Vacuum applied by the suction element 12 also draws the water into the structuring fabric 13 and pulls the fiber into the structuring fabric 13 to develop texture and bulk in the web. Water removed at vacuum element 12 is deposited in pan 14B, and excess water that may be wringing the roll and rewetting the web is doctored from the element using a single, double, or triple doctor 7B.

In preferred embodiments the structuring fabric is a laminated fabric with a web-contacting layer made from extruded polymer netting or 3-D printed material laminated to a woven fabric or a dewatering fabric as described in U.S. Pat. No. 10,208,426. In another preferred embodiment the structuring fabric has a web contacting layer comprising extruded polymer netting or 3-D printed material laminated to a triple layer woven fabric which is then laminated to a dewatering fabric where the fine synthetic batt fibers of the dewatering fabric are preferably needled into the dewatering fabric and through the bottom layer of the triple layer woven fabric of the web contacting layer after the web contacting layer has been laminated to the dewatering fabric. The batting thus reinforces the lamination between the web-contacting layer and dewatering fabric layer to provide for a more durable laminated structuring fabric. With the batting only being needled through the bottom woven layer of the web contacting layer, there exists a batt-free top woven layer of the web contacting layer that is laminated with the extruded polymer netting or 3-D printed material. This batt free layer is porous to allow for water to leave the paper web and quickly penetrate through the web contacting layer, into the dewatering fabric layer, and finally through the dewatering fabric layer into the suction pressure roll and save-all pan as the web is pressed in the press nip. Without being bound by theory, rapid water removal at the press helps provide for even water removal from the web and thus more uniform paper physical properties.

In preferred embodiment, the structuring fabric 13 has a compressible web contacting layer such that under compression in the first and second press nip, the web contacting layer deforms and becomes nearly coplaner but still above the plane of the supporting layer. The compressible web contacting layer increases the area of the paper web that undergoes compression in the press nips thereby increasing water removal, as described in U.S. patent application Ser. No. 16/881,219, the contents of which are incorporated herein by reference in its entirety.

Dewatering fabric 5 runs in an endless loop through a high pressure needle or fan shower 101, flooding shower 15A and a uhle box 16A to remove water and clean the fabric. Guide roll 17 keeps the fabric from varying in movement in the cross machine direction and stretch roll 18 maintains proper fabric tension. If the structuring fabric 13 contains a dewatering fabric layer, the web travels on structuring fabric 13 after leaving the press nip through a dewatering device comprised of a steam box 10A and a vacuum device 19. In other exemplary embodiments, the dewatering device may be omitted. The vacuum device 19 may be, for example, a vacuum roll, vacuum box, or vacuum shoe.

If the structuring fabric does not contain a dewatering fabric layer, then hot air rather than steam can be applied. In this case, the steam box 10A may be replaced with a hot air impingement device/hood and the vacuum device 19 may be replaced with an exhaust duct or a through air drying (TAD) drum. The hot air impingement device/hood blows hot air through the web and structuring fabric 13 into the exhaust duct or TAD drum. In exemplary embodiments, the source air for the hot air may be exhaust air from the hot air impingement hood over the Yankee dryer, or fresh air can be heated using combusted natural gas. A portion of this air can be recirculated, reheated, and reused to minimize energy usage.

Using a hot air impingement device/hood with a vacuum device 19 may be beneficial when using any of the structuring fabrics. Without being bound by theory, it is believed that this combination may improve molding of the sheet into the structuring fabric over the conventional methods mentioned as both the air impingement and vacuum would provide maximum force to push and pull the web into the fabric. Dewatering ability of this arrangement may or may not be improved.

Then the structuring fabric 13 and web pass over a bowed roll 23 to prevent wrinkling of the structuring fabric, through a moisture scanner 100 and then enter the nip between a press element 21 and a steam cylinder 22. A steambox 10B can be positioned over press element 21. The scanner 100 measures the cross direction moisture profile of the web and controls zones in any of the steamboxes to preferentially dry areas of the web to maintain an even moisture profile. The press element 21 may be any of the aforementioned pressing devices but is preferably a suction pressure roll or shoe press. Excess water is doctored from the press element 21 using a single, double, or triple doctor 7C into pan 14C.

In a preferred embodiment, the structuring fabric 13 has a structure that is the same as or similar to that described in U.S. Pat. No. 10,208,426, including a netting layer laminated to a multilayer woven and backside batting that is needle punched into the fabric. The hot air emitted by the steam box 10A is then pushed through the paper web into the vacuum box 19, which is located on the backside of the structuring fabric 13 (the side with the multilayer woven and needle punched batting). Without being bound by theory, it is believed that passing the paper web on the structuring fabric 13 with such a configuration first through a dewatering section made up of the steambox 10A and vacuum device 19 and then to a press section made up of the press element 21 and steam box 10B results in better imprinting of the netting onto the paper web. This configuration also enables a third dewatering step on the same belt without removing the paper web from the belt before transferring the structured paper to the Yankee drier surface.

The web is transferred to the steam heated cylinder 22, which is coated with chemicals via a chemical shower 50 that improves web adhesion to the steam heated cylinder, improves heat transfer through the web, and assists in web removal at the creping doctor 26. The chemicals are constantly applied using a chemical shower or sprayboom 50, while excess is removed using a cleaning doctor blade 27. An additional "cut off" blade 25 is intermittently utilized to allow for blade changes for the creping and cleaning position. The web is dried by the steam heated cylinder 22 along with an installed hot air impingement hood 24 from a solids content of roughly 50% to a solids content of roughly 97.5%.

The web is removed from the steam heated cylinder 22 using a steel or ceramic doctor blade 26 with a pocket angle of 90 degrees at the creping doctor. At this stage, the web properties are influenced by the creping action occurring at the creping doctor. A larger creping pocket angle increases the frequency and fineness of the crepe bars imparted to the web's first exterior surface, which improves surface smoothness. The use of a ceramic doctor blade is preferred because it allows for a fine crepe bar pattern to be imparted to the web for a longer duration of time compared to a steel or bimetal blade. The creping action imparted to the sheet at the blade also improves web flexibility, and the creping action is enhanced as the web adherence to the dryer is increased. The creping force is primarily influenced by the chemistry applied to the steam heated cylinder, the % web contact with the cylinder surface, which is a result of the pattern of the structured fabric, and the percent web solids upon creping.

The web now optionally travels through a set of calendars 60 running, for example, 15% slower than the steam heated cylinder. The action of calendaring improves sheet smoothness but results in lower bulk softness by reducing overall web thickness. The amount of calendaring can be influenced by the attributes needed in the finished product. For example, a low sheet count, 2-ply, rolled sanitary tissue product will need less calendaring than the same roll of 2-ply sanitary product at a higher sheet count and the same roll diameter and firmness. The thickness of the web may need to be reduced using calendaring to allow for more sheets to fit on a roll of sanitary tissue, given limitations to roll diameter and firmness. After calendaring, the web travels through a scanner 160 that measures cross direction basis weight and moisture, and controls actuators inside the headbox to control dilution water to even out the basis weight profile. The web is then reeled using a reel drum 70 into a parent roll 80.

The parent roll 70 can be converted into 1 or 2-ply rolled sanitary or towel products or 1, 2, or 3 ply folded facial tissue products.

In exemplary embodiments, instead of adhering the web to a steam heated cylinder, the web can be removed from the structured fabric to directly proceed to the calendaring section. Any variety of methods can be used to remove the web from the structured fabric. For example, press element 21 can be replaced with an air shower and may be used to transfer the sheet from the structured fabric onto a vacuum roll. The vacuum roll contains a vacuum zone and a zone with positive air pressure used to release the sheet from the roll and allow it to proceed through the calendars. A tube threader system may be used to thread the sheet from this vacuum roll through the calendars and reel drum after a web break. A similar system may be used to thread after a break from the creping doctor when a steam heated cylinder is utilized.

After transferring the web to the steam heated cylinder 22, the structuring fabric 13 travels in an endless loop through high pressure needle or fan showers 102 and 103, flooding shower 15B, and uhle boxes 16B and 16C for fabric cleaning and dewatering. A shower 200 that applies a release chemical such as petroleum oil can be used to aid in later paper web transfer to the drying cylinder. Stretch roll 30 is utilized to maintain fabric tension, and guide roll 31 is utilized to prevent the fabric from varying in movement in the cross machine direction.

Figure 2:
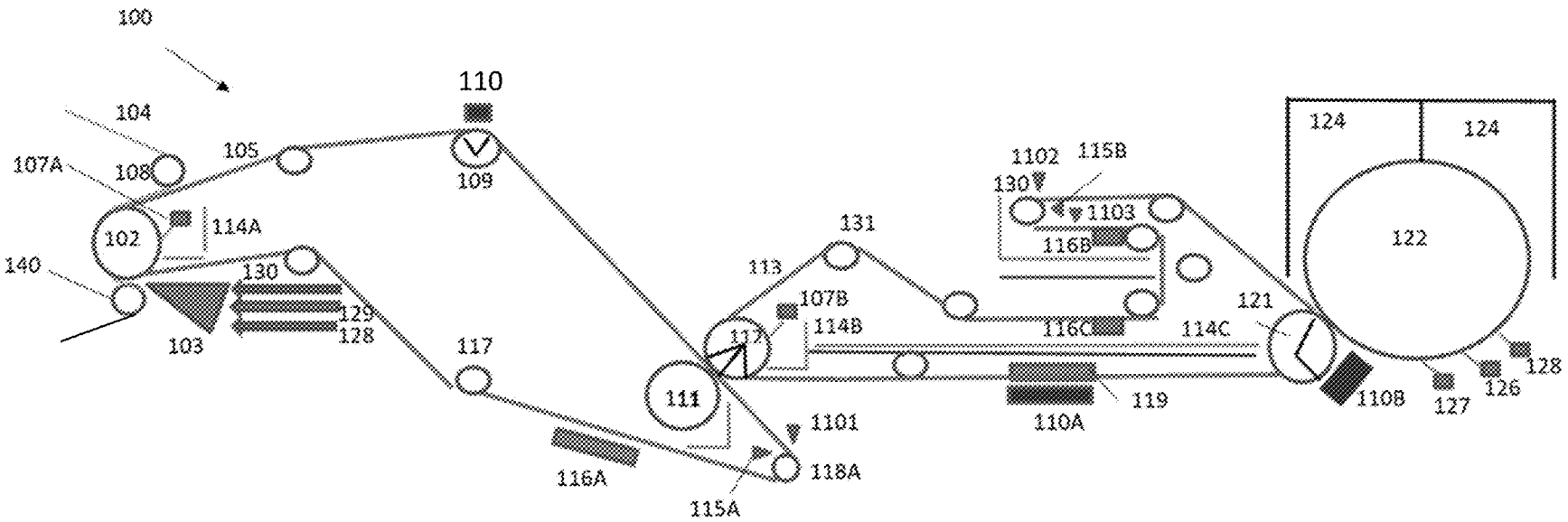
FIG. 2 is a block diagram of a papermaking machine according to another exemplary embodiment of the present invention.

FIG. 2 shows a block diagram of a papermaking machine, generally designated by reference number 100, according to another exemplary embodiment of the present invention. The papermaking machine 100 varies from the machine shown in FIG. 1 in the geometry of the press section. In this case, the structuring fabric 113 has a longer wrap around vacuum element 112 to increase the dwell time and thus dewatering of the web as it travels on the structuring fabric across vacuum element 112. The vacuum element 112 may have more than one vacuum zone. In exemplary embodiments, a vacuum zone at the nip with press element 111 may have an applied vacuum level that is different from that of vacuum zones outside the nip.

More specifically, the papermaking machine 100 includes a first exterior layer fan pump 128, a core layer fan pump 129, and a second exterior layer fan pump 130. The fan pumps 128, 129, 130 move a dilute slurry of fiber and chemicals to a triple layer headbox 103 which deposits the slurry into a nip formed by a forming roll 102, a breast roll 140, an outside forming fabric 104 and an inside dewatering fabric 105.

The outer forming fabric is preferably a triple layer forming fabric, such as, for example, the T-Star AJ-494 Forming Fabric provided by Asten Johnson (4399 Corporate Road, Charleston, South Carolina, USA 29405), but can be any other forming fabric design. Forming fabric 104 runs in an endless loop around a plurality of guide rolls 108 to return back to the breast roll 140.

The forming roll 102 is preferably a solid rubber covered roll, but can be any other type of forming roll, such as an impermeable or permeable roll with an internal vacuum box, and may be covered with a smooth or textured material. The forming roll cover may be made from a material selected from, but not limited to rubber, or polyurethane. The cover may also have a pattern of filaments made of metal or polymer to create a texture.

Excess water may be doctored from the forming roll using a single, double, or triple doctor 107A to aid in removing water that may be wringing the roll and rewetting the web. The water is captured in a pan 114A and directed off the machine to prevent stock and water buildup on the machine frame, which may otherwise lead to drips and holes in the tissue webs and subsequent sheet-breaks and lost operating time.

The dewatering fabric 105 is typically comprised of large polymer monofilaments or multi-filamentous yarns, needled with fine synthetic batt fibers to form a smooth surface for even web pressing. However, any type of dewatering fabric can be used, such as, for example, the fabric shown in FIG. 14A of U.S. Pat. No. 7,476,294, the contents of which are incorporated herein by reference in their entirety, where other absorbent porous materials are incorporated. Another example of a fabric structure that may be used as the dewatering fabric 105 is described in U.S. Pat. No. 10,208,426, and includes nylon woven monofilaments, laminated to extruded polymer netting for compression resistance, and then needle punched with batt fiber on the surface and through the structure.

After separation of the forming and dewatering fabric, a vacuum transfer box is used to assist in nascent web adherence to the dewatering fabric 105. The dewatering fabric 105 then travels with the web across a dewatering suction device comprised of suction roll 109 and steam box 110. In other exemplary embodiments, the dewatering suction device may be omitted. The steambox applies approximately 0.1-1.0 ton of steam per ton of paper to heat the water in the web and lower the viscosity to improve water removal through the suction roll 109. Other dewatering devices known in the art can be used, such as, for example, a vacuum box or suction shoe, which are both non-rotating water removal devices and therefore not preferred as they can cause wear to the dewatering fabric.

The web travels across the dewatering device and into the press section comprised of a press element 111, suction element 112, the dewatering fabric 105, and structuring fabric 113. Press element 111 is preferably an extended nip press, such as, for example, a shoe press or belt press. Extended nip presses extend the time that the paper web remains in the press nip. The amount of water removed in the nip is proportional to the magnitude and the duration of the pressure applied to the paper web. Using an extended nip, the manufacturer can utilize less pressure to achieve the same amount of dewatering while maintaining web bulk and preserving fabric life. Examples of a shoe press include the Advantage ViscoNip Press from Valmet (Keilasatama 5/PO Box 11 FI-02150 ESPOO, FINLAND), and the NipcoFlex T from Voith (St. Pöltener Straße 43 89522 Heidenheim Germany). FIG. 16 of U.S. Pat. No. 7,351,307, the contents of which are incorporated herein by reference in their entirety, shows an example of a suitable belt press. In exemplary embodiments, the shoe press cover may be made of rubber, polyurethane, or other material with through drilled holes, blind drilled holes, grooves, or a combination thereof. Suction element 112 is preferably a suction pressure roll which contains a rubber, polyurethane, or other material cover with through drilled holes, blind drilled holes, grooves, or a combination thereof. Other dewatering devices known in the art can be used, such as, for example, a vacuum box or suction shoe (pickup shoe), which are both non-rotating water removal devices and therefore not preferred as they can cause wear to the structuring fabric. The press section may instead include conventional plain press rolls with a narrow nip width and high nip intensity, or capillary rolls (as described in U.S. Pat. No. 5,701,682, the contents of which are incorporated herein by reference in their entirety), or a combination thereof, although this is not preferred because the web would lose bulk and quality. In an exemplary embodiment, a machine direction dominated pattern on the structuring fabric lines up opposite the grooves on the suction pressure roll for enhanced water removal. As used herein, the term narrow nip width is intended to mean a nip width of less than about 9 cm or from about 4 cm to about 8 cm or less than about 8 cm, and high nip intensity is intended to mean a nip intensity greater than about 5,000 kN/m2 or from about 6,000 to about 12,000 kN/m2 or greater than about 6,000 kN/m2.

The structuring fabric 113 can be of any type described in the background section of this patent application, such as a woven fabric, a woven fabric with an overlaid polymer, welded strips of polymeric material or extruded sheets of polymer which are etched by punching, drilling, or laser drilling, woven fabrics laminated with a 3-D printed web contacting or structuring layer, or a structuring fabric made entirely from 3-D printed material As the web travels on the dewatering fabric 105 through the first press nip, the dewatering fabric 105 and the structuring fabric 113 are subjected to compression and expansion, thereby uptaking and removing water from both sides of the web. Vacuum applied by the suction element 112 also draws the water into the structuring fabric 113 and pulls the fiber into the structuring fabric 113 to develop texture and bulk in the web. Water removed at vacuum element 112 is deposited in pan 114B, and excess water that may be wringing the roll and rewetting the web is doctored from the element using a single, double, or triple doctor 107B.

In preferred embodiments the structuring fabric is a laminated fabric with a web-contacting layer made from extruded polymer netting or 3-D printed material laminated to a woven fabric or a dewatering fabric as described in U.S. Pat. No. 10,208,426. In another preferred embodiment the structuring fabric has a web contacting layer comprising extruded polymer netting or 3-D printed material laminated to a triple layer woven fabric which is then laminated to a dewatering fabric where the fine synthetic batt fibers of the dewatering fabric are preferably needled into the dewatering fabric and through the bottom layer of the triple layer woven fabric of the web contacting layer after the web contacting layer has been laminated to the dewatering fabric. The batting thus reinforces the lamination between the web-contacting layer and dewatering fabric layer to provide for a more durable laminated structuring fabric. With the batting only being needled through the bottom woven layer of the web contacting layer, there exists a batt-free top woven layer of the web contacting layer that is laminated with the extruded polymer netting or 3-D printed material. This batt free layer is porous to allow for water to leave the paper web and quickly penetrate through the web contacting layer, into the dewatering fabric layer, and finally through the dewatering fabric layer into the suction pressure roll and save-all pan as the web is pressed in the press nip. Without being bound by theory, rapid water removal at the press helps provide for even water removal from the web and thus more uniform paper physical properties.

In preferred embodiment, the structuring fabric 113 has a compressible web contacting layer such that under compression in the first and second press nip, the web contacting layer deforms and becomes nearly coplaner but still above the plane of the supporting layer. The compressible web contacting layer increases the area of the paper web that undergoes compression in the press nips thereby increasing water removal, as described in U.S. patent application Ser. No. 16/881,219, the contents of which are incorporated herein by reference in its entirety.

Dewatering fabric 105 runs in an endless loop through a high pressure needle or fan shower 1101, flooding shower 115A and a uhle box 116A to remove water and clean the fabric. Guide roll 117 keeps the fabric from varying in movement in the cross machine direction and stretch roll 118A maintains proper fabric tension. If the structuring fabric 113 contains a dewatering fabric layer, the web travels on structuring fabric 113 after leaving the press nip through a dewatering device comprised of a steam box 110A and a vacuum device 119. In other exemplary embodiments, the dewatering device may be omitted. The vacuum device 119 may be, for example, a vacuum roll, vacuum box, or vacuum shoe.

If the structuring fabric does not contain a dewatering fabric layer, then hot air rather than steam can be applied. In this case, the steam box 110A may be replaced with a hot air impingement device/hood and the vacuum device 119 may be replaced with an exhaust duct or a through air drying (TAD) drum. The hot air impingement device/hood blows hot air through the web and structuring fabric 113 into the exhaust duct or TAD drum. In exemplary embodiments, the source air for the hot air may be exhaust air from the hot air impingement hood over the Yankee dryer, or fresh air can be heated using combusted natural gas. A portion of this air can be recirculated, reheated, and reused to minimize energy usage.

Using a hot air impingement device/hood with a vacuum device 119 may be beneficial when using any of the structuring fabrics. Without being bound by theory, it is believed that this combination may improve molding of the sheet into the structuring fabric over the conventional methods mentioned as both the air impingement and vacuum would provide maximum force to push and pull the web into the fabric. Dewatering ability of this arrangement may or may not be improved.

Then the structuring fabric 113 and web pass may over a bowed roll to prevent wrinkling of the structuring fabric, through a moisture scanner and then enter the nip between a press element 121 and a steam cylinder 122. A steambox 110B can be positioned over press element 121. The scanner measures the cross direction moisture profile of the web and controls zones in any of the steamboxes to preferentially dry areas of the web to maintain an even moisture profile. The press element 121 may be any of the aforementioned pressing devices but is preferably a suction pressure roll or shoe press. Excess water is doctored from the press element 121 using a single, double, or triple doctor into pan 114C.

In a preferred embodiment, the structuring fabric 113 has a structure that is the same as or similar to that described in U.S. Pat. No. 10,208,426, including a netting layer laminated to a multilayer woven and backside batting that is needle punched into the fabric. The hot air emitted by the steam box 10A is then pushed through the paper web into the vacuum box 119, which is located on the backside of the structuring fabric 113 (the side with the multilayer woven and needle punched batting). Without being bound by theory, it is believed that passing the paper web on the structuring fabric 113 with such a configuration first through a dewatering section made up of the steambox 110A and vacuum device 119 and then to a press section made up of the press element 121 and steam box 110B results in better imprinting of the netting onto the paper web. This configuration also enables a third dewatering step on the same belt without removing the paper web from the belt before transferring the structured paper to the Yankee drier surface.

The web is transferred to the steam heated cylinder 122, which is coated with chemicals via a chemical shower that improves web adhesion to the steam heated cylinder, improves heat transfer through the web, and assists in web removal at the creping doctor 126. The chemicals are constantly applied using a chemical shower or sprayboom, while excess is removed using a cleaning doctor blade 127. An additional "cut off" blade 128 is intermittently utilized to allow for blade changes for the creping and cleaning position. The web is dried by the steam heated cylinder 122 along with an installed hot air impingement hood 124 from a solids content of roughly 50% to a solids content of roughly 97.5%.

The web is removed from the steam heated cylinder '22 using a steel or ceramic doctor blade 126 with a pocket angle of 90 degrees at the creping doctor. At this stage, the web properties are influenced by the creping action occurring at the creping doctor. A larger creping pocket angle increases the frequency and fineness of the crepe bars imparted to the web's first exterior surface, which improves surface smoothness. The use of a ceramic doctor blade is preferred because it allows for a fine crepe bar pattern to be imparted to the web for a longer duration of time compared to a steel or bimetal blade. The creping action imparted to the sheet at the blade also improves web flexibility, and the creping action is enhanced as the web adherence to the dryer is increased. The creping force is primarily influenced by the chemistry applied to the steam heated cylinder, the % web contact with the cylinder surface, which is a result of the pattern of the structured fabric, and the percent web solids upon creping.

The web now optionally travels through a set of calendars running, for example, 15% slower than the steam heated cylinder. The action of calendaring improves sheet smoothness but results in lower bulk softness by reducing overall web thickness. The amount of calendaring can be influenced by the attributes needed in the finished product. For example, a low sheet count, 2-ply, rolled sanitary tissue product will need less calendaring than the same roll of 2-ply sanitary product at a higher sheet count and the same roll diameter and firmness. The thickness of the web may need to be reduced using calendaring to allow for more sheets to fit on a roll of sanitary tissue, given limitations to roll diameter and firmness. After calendaring, the web travels through a scanner that measures cross direction basis weight and moisture, and controls actuators inside the headbox to control dilution water to even out the basis weight profile. The web is then reeled using a reel drum into a parent roll.

The parent roll can be converted into 1 or 2-ply rolled sanitary or towel products or 1, 2, or 3 ply folded facial tissue products.

In exemplary embodiments, instead of adhering the web to a steam heated cylinder, the web can be removed from the structured fabric to directly proceed to the calendaring section. Any variety of methods can be used to remove the web from the structured fabric. For example, press element 21 can be replaced with an air shower and may be used to transfer the sheet from the structured fabric onto a vacuum roll. The vacuum roll contains a vacuum zone and a zone with positive air pressure used to release the sheet from the roll and allow it to proceed through the calendars. A tube threader system may be used to thread the sheet from this vacuum roll through the calendars and reel drum after a web break. A similar system may be used to thread after a break from the creping doctor when a steam heated cylinder is utilized.

After transferring the web to the steam heated cylinder 122, the structuring fabric 113 travels in an endless loop through high pressure needle or fan showers 1102 and 1103, flooding shower 115B, and uhle boxes 116B and 116C for fabric cleaning and dewatering. A shower that applies a release chemical such as petroleum oil can be used to aid in later paper web transfer to the drying cylinder. Stretch roll 130 is utilized to maintain fabric tension, and guide roll 131 is utilized to prevent the fabric from varying in movement in the cross machine direction.

In exemplary embodiments, during the papermaking process, the paper web being conveyed on a structuring fabric is transferred to the Yankee dryer at a nip formed between the Yankee dryer and a pressure roll. During this transfer (referred to herein as "soft nip transfer"), the web contacting surface (in some cases, extruded polymer netting) of the structuring fabric is compressed in the nip between the pressure roll and Yankee dryer such that the top plane of a first element of the structuring fabric is substantially in the same plane as the top plane of a second element of the structuring fabric. More specifically, the soft nip transfer results in compression and deflection of the web contacting layer of the structuring fabric, which in turn results in a higher contact area between the web and the structuring fabric and between the web and Yankee dryer.

A composite or laminated structuring fabric according to an exemplary embodiment of the present invention includes a web contacting layer with a top plane that has a contact area with the Yankee dryer between 15% to 45% in the uncompressed state but increases to 30% to 60% contact area in the compressed state when under 200 to 300 PLI load, which is the typical load range that exists in the nip between the pressure roll and Yankee dryer. In this regard, the top plane of first elements of the structuring fabric is substantially in the same plane as the top plane of second elements of the structuring fabric when the top plane of the web contacting layer has a contact area with the Yankee dryer between 30% to 60%. The contact area increases as the first elements are compressed into the same plane as the second elements. It should be appreciated that one of ordinary skill in the art would understand that the paper web is molded into the web contacting layer of the structuring fabric. Thus, one of ordinary skill in the art would also understand that the term "contact area" as used herein in the context of the structuring fabric is actually the contact area of the structuring fabric with the paper web molded into the web contacting layer of the structuring fabric.

Figure 3:
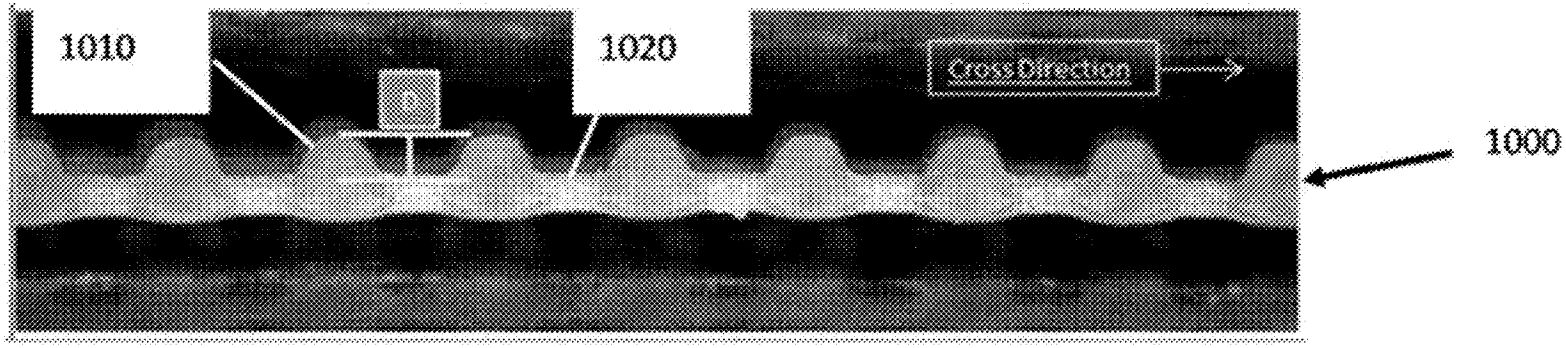
FIG. 3 is a micrograph showing a cross-section of a web contacting layer of a structuring fabric according to an exemplary embodiment of the present invention.

FIG. 3 is a micrograph showing a cross-section of a web contacting layer, generally designated by reference number 1000, of a structuring fabric according to an exemplary embodiment of the present invention. The web contacting layer 1000 is preferably made of an extruded polymer netting having first elements 1010 extending in the machine direction and second elements 1020 extending the cross direction so as to form openings within the web contacting layer 1000. As shown in FIG. 3, the first elements 1010 extend above the second elements 1020 so as to form ridges extending in the machine direction. The second elements 1020 extending in the cross direction may be referred to herein as "mid-rib" elements.

In exemplary embodiments, the distance (D) between the top plane of the ridges of the first elements 1010 and the top plane of the second elements 1020 is greater than 200 microns. As discussed, during the papermaking process, the paper web being conveyed on the composite structuring fabric is transferred to the Yankee dryer at a nip formed between the Yankee dryer and a pressure roll. During this soft nip transfer, the extruded polymer netting of the composite structuring fabric is compressed and deflected in the nip between the pressure roll and Yankee dryer such that the top plane of the first element 1010 is substantially in the same plane as the top plane of the second element 1020. In an exemplary embodiment, the top plane of the web contacting layer 1000 has a contact area with the Yankee dryer between 15% to 45% in the uncompressed state but increases to 30 to 60% contact area in the compressed state when under 200 to 300 PLI load. In this regard, the top plane of the first elements 1010 of the structuring fabric 1000 is substantially in the same plane as the top plane of the second elements 1020 of the structuring fabric 1000 when the top plane of the web contacting layer of the structuring fabric 1000 has a contact area with the Yankee dryer between 30% to 60%. The contact area increases as the first elements 1010 are compressed into the same plane as the second elements 1020. It should be appreciated that the systems and processes described herein are not limited to the use of this exemplary structuring fabric, and other structuring fabrics may be used to achieve the objects and advantages of the present invention. Further, it should be appreciated that the structuring fabric may be compressed and deflected in any one of the nips within the papermaking machine so as to result in a soft nip transfer.

Figure 4:
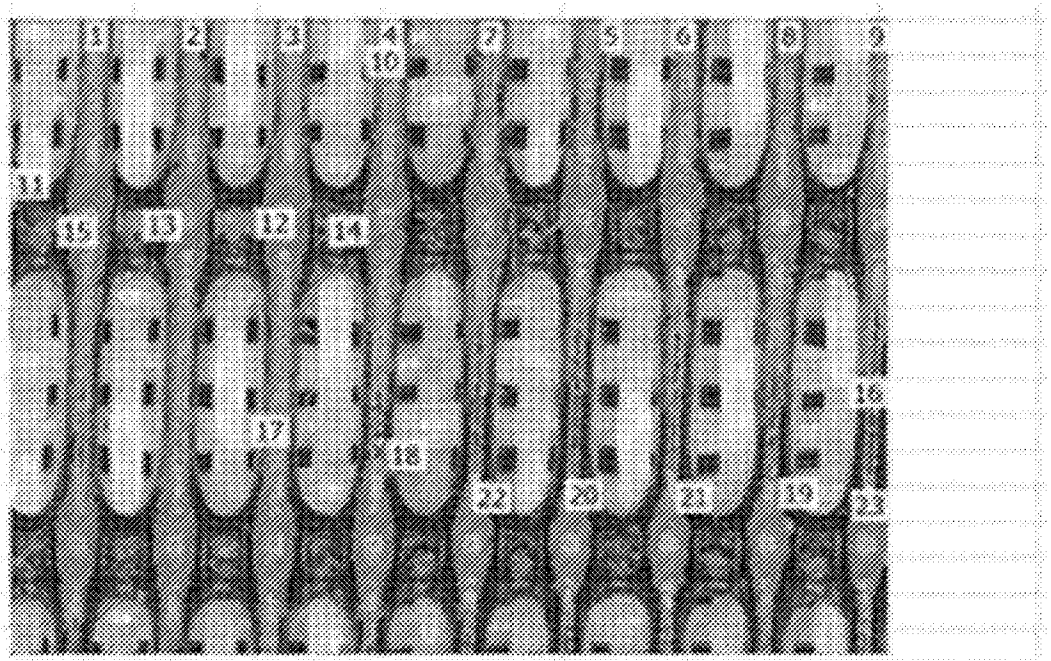
FIG. 4 illustrates contact area of a structured tissue belt assembly according to an exemplary embodiment of the present invention as the belt approaches a nip between a press roll and a Yankee dryer.
Figure 5:
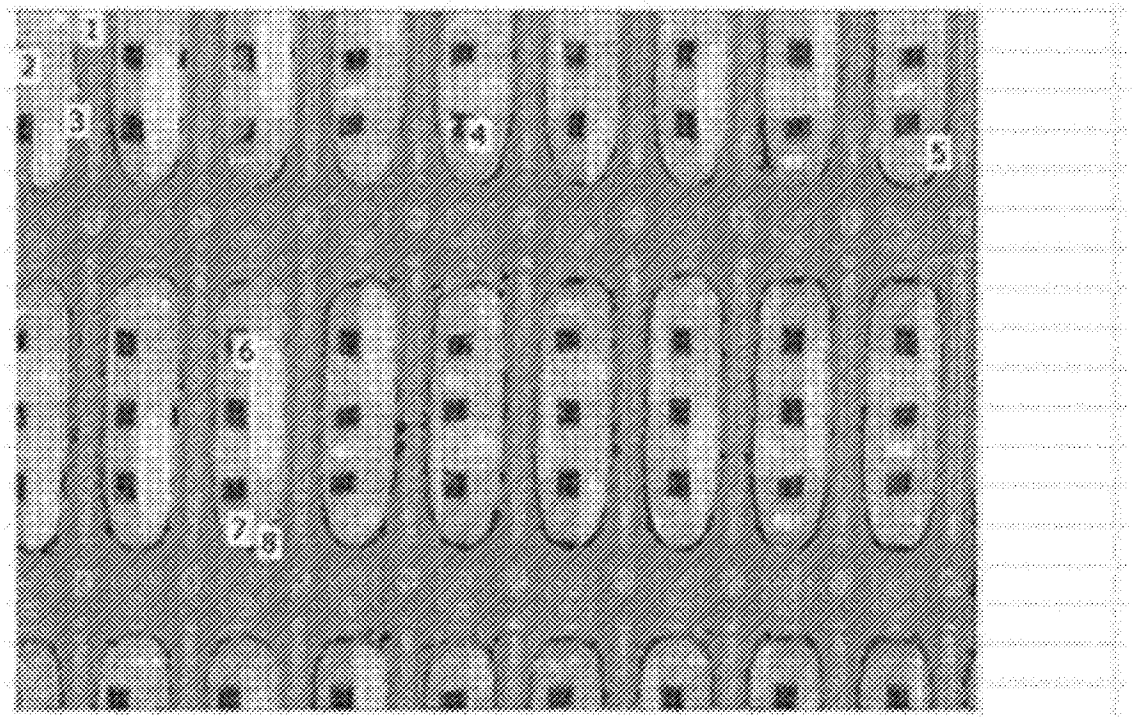
FIG. 5 illustrates contact area of the structured tissue belt assembly of FIG. 4 within the nip.
Figure 6:
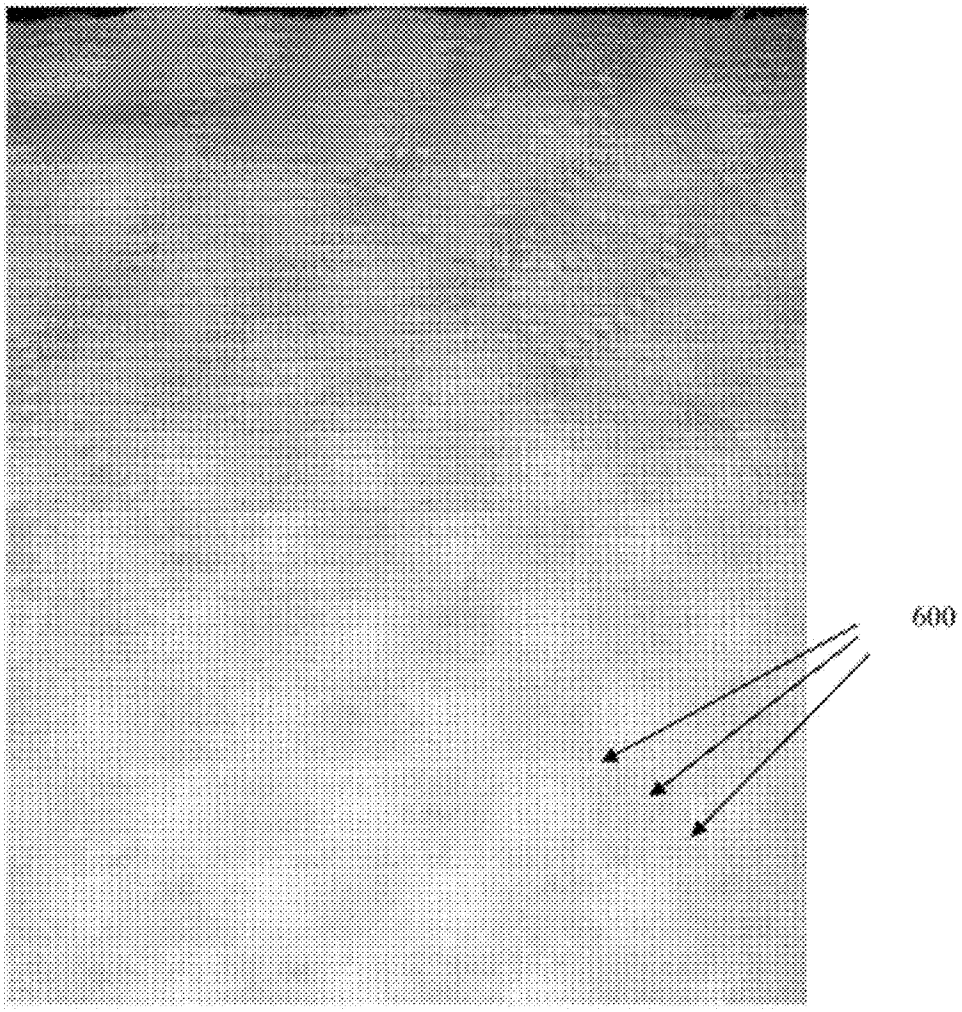
FIG. 6 is a photograph showing a bath tissue product according to an exemplary embodiment of the present invention.

FIGS. 4 and 5 are micrographs showing a structuring fabric according to an exemplary embodiment of the present invention having a 28% surface contact area with the Yankee dryer leading into the nip (FIG. 4) and a 54% surface contact area with the Yankee dryer in the nip (FIG. 5). FIG. 6 is a photograph showing a bath tissue product according to an exemplary embodiment of the present invention resulting from the soft nip transfer shown in FIGS. 4 and 5. In FIG. 6, cross-direction ridges 600 can be seen on the surface of the tissue product, resulting from the compression and deflection of the mid-rib elements of the structuring fabric.

Now that embodiments of the present invention have been shown and described in detail, various modifications and improvements thereon will become readily apparent to those skilled in the art. Accordingly, the spirit and scope of the present invention is to be construed broadly and not limited by the foregoing specification.

We claim:

1. A papermaking machine comprising:

(A) a wet section for forming a nascent paper web, the wet section comprising a gap former into which is deposited a paper slurry from a headbox to form the nascent paper web, the gap former comprising:
  (i) a forming wire; and
  (ii) a dewatering fabric, the dewatering fabric running in an endless loop about a forming roll, a suction roll and a first press element;

(B) a first dewatering section comprising the suction roll and a first steam box through which passes the nascent paper web to form a partially dewatered paper web;

(C) a press section for pressing the partially dewatered paper web, the press section comprising:
  (i) the first press element with an inside surface of the dewatering fabric in contact with the first press element;
  (ii) a structuring belt with an inside surface of the structuring belt in contact with a suction element; and
  (iii) a first nip, formed between the dewatering fabric in contact with the first press element and the structuring belt in contact with the suction element, in which the partially dewatered paper web is pressed and transferred to the structuring belt;

(D) a second dewatering section comprising a hot air hood and a through air drying (TAD) drum, through which passes the partially dewatered paper web travelling on the structuring belt; and (E) a drying section for drying the partially dewatered paper web to form a dried web, the drying section comprising:
  (i) a second press element with the inside surface of the structuring fabric in contact with the second press element;
  (ii) a steam heated cylinder; and
  (iii) a second nip, formed between the structuring fabric in contact with the second press element and the steam heated cylinder, in which the partially dewatered paper web is pressed and transferred to the steam heated cylinder, wherein the dried web is creped off the steam heated cylinder.

2. The papermaking machine of claim 1, wherein the dewatering fabric comprises polymer monofilaments or multi-filamentous yarns, needled with fine synthetic batt fibers.

3. The papermaking machine of claim 2, wherein the dewatering fabric further comprises absorbent porous materials.

4. The papermaking machine of claim 2, wherein the dewatering fabric further comprises extruded polymer netting.

5. The papermaking machine of 1, wherein the first press element is an extended nip press.

6. The papermaking machine of claim 5, wherein the press section extended nip press is a shoe press or belt press.

7. The papermaking machine of claim 6, wherein the press section extended nip press comprises a sleeve which is plain grooved, blind drilled, through drilled, or a combination thereof.

8. The papermaking machine of claim 1, wherein the suction element is a suction pressure roll.

9. The papermaking machine of claim 8, wherein the suction pressure roll comprises a roll cover made of polymeric material, where the cover of the press is grooved, blind drilled, through drilled, or a combination thereof.

10. The papermaking machine of claim 1, wherein the suction element is a vacuum box or suction pickup shoe.

11. The papermaking machine of claim 1, wherein the structuring belt is of a type selected from the group consisting of: a woven fabric, a woven fabric with an overlaid polymer, welded strips of polymeric material or extruded sheets of polymer which are etched by punching, drilling, or laser drilling, woven fabrics laminated with a 3-D printed web contacting or structuring layer, a structuring fabric made entirely from 3-D printed material, a laminated structuring fabric with a web-contacting layer made from extruded polymer netting or 3-D printed material laminated to a woven fabric or a dewatering fabric, and a fabric comprising a web-contacting layer made from extruded polymer netting or 3-D printed material laminated to a triple layer woven fabric which is then laminated to a dewatering fabric where fine synthetic batt fibers of the dewatering fabric are needled into the dewatering fabric and through a bottom layer of the triple layer woven fabric of the web contacting layer after the web contacting layer has been laminated to the dewatering fabric.

12. The papermaking machine of claim 1, wherein the structuring belt is a laminated fabric comprising a web contacting layer made from extruded polymer netting or 3-D printed material and a non-web contacting layer made of a woven fabric or a dewatering fabric.

13. The papermaking machine of claim 1, wherein the drying section press element comprises a shoe press, a suction pressure roll, or a plain press roll with a narrow nip width and high nip intensity.

14. The papermaking machine of claim 13, wherein the drying section press element is a shoe press, and the shoe press comprises a sleeve and the sleeve of the press is plain, grooved, blind drilled, through drilled, or a combination thereof.

15. The papermaking machine of claim 13, wherein the drying section press element is a suction pressure roll, and the section pressure roll has a roll cover made of rubber, polyurethane, or other polymers and the cover is grooved, blind drilled, through drilled, or a combination thereof.

16. The papermaking machine of claim 1, wherein the vacuum device comprises a vacuum roll, vacuum box, or vacuum shoe.

17. The papermaking machine of claim 1, wherein the first press element is a conventional plain press roll with a narrow nip width and high nip intensity with a rubber or polyurethane cover that is flat or has blind drilled holes and/or grooves.

18. The papermaking machine of claim 1, wherein the first press element is a capillary dewatering roll.

19. The papermaking machine of claim 1, wherein travel speed of the dewatering fabric is the same or different from travel speed of the structuring belt.

20. The papermaking machine of claim 1, wherein the structuring belt functions as a dewatering belt.

21. A papermaking machine comprising:

(A) a wet section for forming a nascent paper web, the wet section comprising a gap former into which is deposited a paper slurry from a headbox to form the nascent paper web, the gap former comprising:
  (i) a forming wire; and
  (ii) a dewatering fabric, the dewatering fabric running in an endless loop about a forming roll and a first press element;

(B) a press section for pressing a partially dewatered paper web formed from the nascent web, the press section comprising:
  (i) the first press element with an inside surface of the dewatering fabric in contact with the first press element;
  (ii) a structuring belt with an inside surface of the structuring belt in contact with a suction element; and
  (iii) a first nip, formed between the dewatering fabric in contact with the first press element and the structuring belt in contact with the suction element, in which the partially dewatered paper web is pressed and transferred to the structuring belt;

(C) a dewatering section comprising a hot air hood and a through air drying (TAD) drum, through which passes the partially dewatered paper web travelling on the structuring belt; and (D) a drying section for drying the partially dewatered paper web to form a dried web, the drying section comprising:
  (i) a second press element with the inside surface of the structuring fabric in contact with the second press element;
  (ii) a steam heated cylinder; and
  (iii) a second nip, formed between the structuring fabric in contact with the second press element and the steam heated cylinder, in which the partially dewatered paper web is pressed and transferred to the steam heated cylinder, wherein the dried web is creped off the steam heated cylinder.

22. A method for making paper comprising:

(A) forming a nascent paper web by depositing a paper slurry from a headbox into a gap former of a wet section of a papermaking machine, the gap former comprising:
  (i) a forming wire; and
  (ii) a dewatering fabric, the dewatering fabric running in an endless loop about a forming roll, a suction roll and a first press element;

(B) forming a partially dewatered paper web by passing the nascent paper web through a first dewatering section of the papermaking machine comprising the suction roll and a first steam box;

(C) pressing the partially dewatered paper web at a press section of the papermaking machine, the press section comprising:
  (i) the first press element with an inside surface of the dewatering fabric in contact with the first press element;
  (ii) a structuring belt with an inside surface of the structuring belt in contact with a suction element; and
  (iii) a first nip, formed between the dewatering fabric in contact with the first press element and the structuring belt in contact with the suction element, in which the partially dewatered paper web is pressed and transferred to the structuring belt;

(D) passing the partially dewatered paper web travelling on the structuring belt through a second dewatering section of the papermaking machine comprising a hot air hood and a through air drying (TAD) drum;

(E) drying the partially dewatered paper web at a drying section of the papermaking machine to form a dried web, the drying section comprising:
  (i) a second press element with the inside surface of the structuring fabric in contact with the second press element;
  (ii) a steam heated cylinder; and
  (iii) a second nip, formed between the structuring fabric in contact with the second press element and the steam heated cylinder, in which the partially dewatered paper web is pressed and transferred to the steam heated cylinder, wherein the structuring fabric at the second nip is compressed resulting in a top plane of a first element of the structuring fabric being in substantially the same plane as a top plane of a second element of the structuring fabric; and (F) creping the dried web off the steam heated cylinder.

23. A papermaking machine comprising:

(A) a wet section for forming a nascent paper web, the wet section comprising a gap former into which is deposited a paper slurry from a headbox to form the nascent paper web, the gap former comprising:
  (i) a forming wire; and
  (ii) a dewatering fabric, the dewatering fabric running in an endless loop about a forming roll, a suction roll and a first press element;

(B) a first dewatering section comprising the suction roll and a first steam box through which passes the nascent paper web to form a partially dewatered paper web;

(C) a press section for pressing the partially dewatered paper web, the press section comprising:
  (i) the first press element with an inside surface of the dewatering fabric in contact with the first press element;
  (ii) a structuring belt with an inside surface of the structuring belt in contact with a suction element; and
  (iii) a first nip, formed between the dewatering fabric in contact with the first press element and the structuring belt in contact with the suction element, in which the partially dewatered paper web is pressed and transferred to the structuring belt; and
(D) a second dewatering section comprising a hot air hood and a through air drying (TAD) drum, through which passes the partially dewatered paper web travelling on the structuring belt.

24. A papermaking machine comprising:
(A) a wet section for forming a nascent paper web, the wet section comprising a gap former into which is deposited a paper slurry from a headbox to form the nascent paper web, the gap former comprising:
  (i) a forming wire; and
  (ii) a dewatering fabric, the dewatering fabric running in an endless loop about a forming roll and a first press element;
(B) a press section for pressing a partially dewatered paper web formed from the nascent web, the press section comprising:
  (i) the first press element with an inside surface of the dewatering fabric in contact with the first press element;
  (ii) a structuring belt with an inside surface of the structuring belt in contact with a suction element; and
  (iii) a first nip, formed between the dewatering fabric in contact with the first press element and the structuring belt in contact with the suction element, in which the partially dewatered paper web is pressed and transferred to the structuring belt; and
(C) a dewatering section comprising a hot air hood and a through air drying (TAD) drum, through which passes the partially dewatered paper web travelling on the structuring belt.

25. A method for making paper comprising:
(A) forming a nascent paper web by depositing a paper slurry from a headbox into a gap former of a wet section of a papermaking machine, the gap former comprising:
  (i) a forming wire; and
  (ii) a dewatering fabric, the dewatering fabric running in an endless loop about a forming roll, a suction roll and a first press element;
(B) forming a partially dewatered paper web by passing the nascent paper web through a first dewatering section of the papermaking machine comprising the suction roll and a first steam box;
(C) pressing the partially dewatered paper web at a press section of the papermaking machine, the press section comprising:
  (i) the first press element with an inside surface of the dewatering fabric in contact with the first press element;
  (ii) a structuring belt with an inside surface of the structuring belt in contact with a suction element; and
  (iii) a first nip, formed between the dewatering fabric in contact with the first press element and the structuring belt in contact with the suction element, in which the partially dewatered paper web is pressed and transferred to the structuring belt; and
(D) passing the partially dewatered paper web travelling on the structuring belt through a second dewatering section of the papermaking machine comprising a hot air hood and a through air drying (TAD) drum.

* * * * *